United States Patent [19]

Bourcier et al.

[11] Patent Number: 4,991,399

[45] Date of Patent: Feb. 12, 1991

[54] DEVICE FOR TEMPORARILY OVERCOOLING A COOLED DETECTOR AND DETECTOR COMPRISING SUCH A COOLING DEVICE

[75] Inventors: Henri Bourcier, Marolles en Brie; Marc Pochard, Limeil Brevannes, both of France

[73] Assignee: U.S. Philips Corp., New York, N.Y.

[21] Appl. No.: 280,614

[22] Filed: Dec. 5, 1988

[30] Foreign Application Priority Data

Dec. 18, 1987 [FR] France ..... 87 17713

[51] Int. Cl.[5] ..... F25B 21/02

[52] U.S. Cl. ..... 62/3.2

[58] Field of Search ..... 62/3.2, 3.3, 3.6

[56] References Cited

U.S. PATENT DOCUMENTS 4,066,365 1/1978 Staunton ..... 62/3.2 X 4,474,015 10/1984 Christmas et al. ..... 62/3.2

4,490,982 1/1985 Christmas ..... 62/3.2

4,512,758 4/1985 Wedenmeyer et al. ..... 62/3.2 X 4,833,889 5/1989 Harwell et al. ..... 62/3.2

*Primary Examiner*—Lloyd L. King

*Attorney, Agent, or Firm*—Ernestine C. Bartlett

[57] ABSTRACT

A device for temporarily overcooling a detector (1) cooled permanently in a space by means of a first cooler (5).

According to the invention, a second cooler (6) is temporarily made operative to produce the required overcooling without causing heat exchange with the outside. For this purpose, the thermal energy dissipated by the cooler (6) is absorbed by the passage from solid to liquid of a material changing in phase (7) (water or tetradecane) arranged between the first and second coolers.

3 Claims, 1 Drawing Sheet

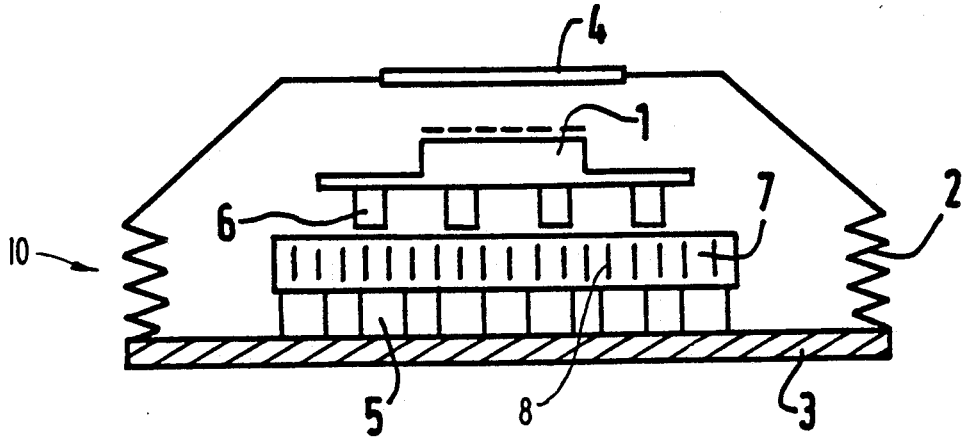
4
1
7
2
6
10
5
8
3

DEVICE FOR TEMPORARILY OVERCOOLING A COOLED DETECTOR AND DETECTOR COMPRISING SUCH A COOLING DEVICE

The invention relates to a device for temporarily overcooling a detector cooled permanently in a space by means of a first cooler.

FIELD OF THE INVENTION

The invention relates also to a detector provided with such a cooling device.

A device of this kind is used, for example, in telescopes which are mounted on missiles and which are utilized for a duaration of the order of a few seconds.

BACKGROUND OF THE INVENTION

These telescopes are equipped with CCD detectors operating in the visible range and are cooled to a low temperature (0° to 5° C.) in a space whose temperature is controlled by a thermostat.

During the pointing time, these detectors are subjected to attacks of nuclear radiation. The CCD components are formed from semiconductor materials, whose parameters are degraded when the detector is struck by a bombardment of particles. This happen because at a constant temperature the dark current increases. Since this current decreases with temperature, it is necessary to overcool or cool when this current has increased in order to re-establish the increased current to its desired value in the absence of nuclear attack and thus to maintain the initial sensitivity of the detector.

SUMMARY OF THE INVENTION

An object of this invention to provide a device ensuring this overcooling for the duration of use of the detector without causing disturbances in the thermal equilibrium of the assembly.

For this purpose, the invention is characterized in that a second cooler is temporarily made operative to produce the required overcooling without causing heat exchange with the outside, this result being attained by the fact that the thermal energy dissipated by the said second cooler is absorbed by the passage from the solid state to the liquid state of a material changing in phase chosen as a function of the permanent operating temperature and arranged between the said first and second coolers so that the overall energetic balance is zero and that the external environment is not thermally disturbed as long as the duration of the overcooling does not exceed the duration of absorption of the said material changing in phase.

BRIEF DESCRIPTION OF THE DRAWING

In order that the invention may be readily carried out, it will now be described more fully, by way of example, with reference to the accompanying drawing.

The sole Figure shows a diagrammatic sectional view of the overcooling device according to the invention.

DETAILED DESCRIPTION OF PREFERRED EMBODIMENTS

The detector 1 is arranged within a housing 10 whose lateral surface 2 is formed from a material of low thermal conductivity and whose bottom 3 is a support in contact with the external environment.

The part of the housing opposite to the detector is provided with an opening obturated by a transparent window 4.

The detector is, for example, CCD matrix.

A first cooler 5 is brought into contact with the support 3, while a second cooler 6 is brought into contact with the detector. These two coolers operate, for example, using the Peltier effect.

A space 7 containing a material changing in phase (solid-liquid) 8 is interposed between the coolers 5 and 6. This material is chosen as a function of the permanent operating temperature: water for a temperature of 0° C., tetradecane for a temperature of 5° C. The space contains, for example, 0.5 g of water.

The first cooler 5 ensures permanently the cooling of the assembly comprising the detector 1, the cooler 5 (out of operation) and the space 7 containing the material changing in phase.

When an overcooling of the dector is necessary the second cooler 6 using the Peltier effect is made operative. The thermal energy dissipated by this color is absorbed by the passage from the solid state to the liquid state of the material changing in phase without disturbance of the external enviroment on the condition that the duration of overcooling does not exceed the duration of absorption capacity of the material.

Such a device can ensure an overcooling of 20° C. for a duration of a bout 20 seconds.

One of the advantages of this device is that it can operate as many times as is desired because after the overcooling the part of substance in the liquid state returns to the solid state and the system is ready to operate again.

As typical applications may be mentioned:

the telescope comprising a CCD matrix integrated in the core of an inertia equipment having an isolated core. for this application, pointing is effected in one step and lasts only 10 seconds with a constraint which ensures the stability of the heat exchange from core to telescope, for which the device proposed is entirely adapted.

The telescope comprising a CCD matrix integrated on a statellite carrying out stellar readjustment measurements only a few times per orbit. In this instance the overcooler is made operative only if in the course of years the dark current should increase excessively.

What is claimed is:

1. A device for temporarily overcooling a detector cooled permanently in a space by means of a first cooler, said device comprising a housing having a bottom wall, adjoining lateral surfaces and at least one wall that includes a transparent window; a detector arranged within said housing opposite the window; a first cooler in contact with the bottom wall; a second cooler in contact with the detector, said first and second coolers operating using the Peltier effect; and a space containing a material changing in phase from solid phase to liquid phase in response to a predetermined temperature change, said space being interposed between said first and second coolers, wherein said second cooler is temporarily made operative using the Peltier effect to produce the required overcooling without causing heat exchange with the outside as a result of thermal energy dissipated by the said second cooler being absorbed by the passage from the solid state to the liquid state of said material changing in phase, said material being chosen as a function of the permanent operating so that the overall energetic balance is zero whereby the external enviroment is not thermally disturbed as long as the duration of the overcooling does not exceed the duratrion of absorption of said material changing phase.

2. An overcooling device as claimed in claim 1, wherein the said material changing in phase is water if the permanent operating temperature is 0° C. and tetradecane if the permanent operating temperature is 5° C.

3. A detector comprising a cooling device as claimed in claim 1 or 2.

* * * * *